United States Patent [19]

Lohmüller et al.

[11] 4,294,932

[45] Oct. 13, 1981

[54] METHANATION PROCESS

[75] Inventors: Reiner Lohmüller, Munich; Helmut Schneider, Grünwald; Allan Watson, Ottobrunn, all of Fed. Rep. of Germany

[73] Assignee: Linde AG, Wiesbaden, Fed. Rep. of Germany

[21] Appl. No.: 64,831

[22] Filed: Aug. 8, 1979

Related U.S. Application Data

[63] Continuation of Ser. No. 875,903, Feb. 7, 1978, abandoned.

[30] Foreign Application Priority Data

Feb. 8, 1977 [DE] Fed. Rep. of Germany ..... 2705151

[51] Int. Cl.[3] ..... C10K 3/04

[52] U.S. Cl. ..... 518/706; 48/197 R; 518/712

[58] Field of Search ..... 48/197 R, 214 A; 260/449 M, 449.6 M, 449 S, 449.6 R, 449.5; 252/373; 208/10; 423/655, 659

[56] References Cited

U.S. PATENT DOCUMENTS

| | | | |
|---|---|---|---|
| 3,771,261 | 11/1973 | Mandelik et al. | 48/197 R |
| 3,938,968 | 2/1976 | White et al. | 48/197 R |
| 3,954,424 | 5/1976 | Goeke et al. | 48/197 R |
| 4,005,996 | 2/1977 | Hansberger et al. | 48/197 R |

*Primary Examiner*—Peter F. Kratz

*Attorney, Agent, or Firm*—Karl F. Ross

[57] ABSTRACT

Strongly exothermic, catalytically induced or promoted chemical reactions, e.g. the production of methane by the reaction of hydrogen with carbon oxides, are carried out by passing the reactants through an isothermically operated reactor in addition to an adiabatic reactor.

1 Claim, 3 Drawing Figures

METHANATION PROCESS

This is a continuation of application Ser. No. 875,903, filed Feb. 7, 1978 now abandoned.

FIELD OF THE INVENTION

The present invention relates to a method of and to an apparatus for carrying out catalytically promoted strongly exothermic chemical reactions and, more particularly, exothermic reactions such as the production of methane by the hydrogenation of carbon oxides such as carbon monoxide and carbon dioxide.

BACKGROUND OF THE INVENTION

In carrying out strongly exothermic catalytically promoted reactions, a major problem arises in the control of the heat realized by the reactions. It has been found, for example in the methanization of carbon oxides, i.e. the reaction of carbon oxides with hydrogen in accordance with the relationships, $$CO+3H_2 \rightleftharpoons CH_4+H_2O+Q$$

$$CO_2+4H_2 \rightleftharpoons CH_4+2H_2O+Q$$

that the evolution of the reaction heat Q is so great that especially severe problems arise, particularly in the case of high carbon monoxide concentrations, with respect to control of the reaction.

To avoid such difficulties, it has been proposed in German printed application (Auslegeschrift) DT-AS 12 71 301, to carry out the methane-production reaction in a step-wise manner in a plurality of successive (cascaded) adiabatically operated reactors. The capital costs of such installations are, however, very high, especially since the initial reactors must be provided with expensive linings or from refractory materials of high cost in order to withstand the high temperatures which must be sustained by the reactors.

German open application (Offenlegungsschrift) DT-OS 23 35 659 (corresponding to U.S. Pat. No. 3,958,956) discloses the production of methane-rich gases in isothermically operated reactors. Since lower temperatures prevail in isothermically operated reactors than in adiabatically operated reactors, the problems mentioned previously can be at least partly eliminated. However, in the latter process, it is found to be necessary to add to the reactants before they enter the isothermically operated reactor, a significant quantity of water vapor or steam. A disadvantage of this process is that the methanization reaction can only be carried out opitmally when the water is mixed with its reactants in special gas/liquid mass-exchange or contact systems. It is especially important to introduce superheated steam so that the threshold temperature necessary to trigger the exothermic reaction can be developed within the reactor.

The isothermically operated reaction system is also characterized by the significant technological disadvantage that precise control of the strongly exothermic reaction can only be effected by relatively complex and expensive process-control instruments and equipment. The control of the reaction is particularly difficult when the rate at which the feed stock is supplied to the reactor varies over a significant range.

OBJECTS OF THE INVENTION

It is the principal object of the present invention to provide an improved method of and apparatus for carrying out catalytically promoted strongly exothermic reactions whereby the disadvantages of the earlier systems enumerated above can be avoided.

It is another object of this invention to provide a process for carrying out reactions of the type described, particularly the production of methane by the reaction of hydrogen with carbon oxides such as carbon dioxide and carbon monoxide, in which the capital expenditure for the reaction system is reduced, wherein the problem of control of the reaction is minimized, and wherein the system can sustain relatively large fluctuations in the rate at which the feed stock is supplied to the system, by comparison with earlier processes.

Still another object of the invention is to provide an improved installation for carrying out strongly exothermic catalytically promoted reactions, particularly those which involve the hydrogenation of carbon dioxide and carbon monoxide.

SUMMARY OF THE INVENTION

These objects and others which will become apparent hereinafter are attained, in accordance with the present invention, by passing the reactants through an isothermically operated reactor in addition to an adiabatically operated reactor. It should be understood that an isothermically operated reactor is one which is maintained, during the reaction, at a constant temperature, practically independently of the heat evolved during the reaction. An adiabatically operated reactor, of course, is one which has substantially no external heat input or external heat output.

According to a feature of the invention, the cost of the apparatus can be minimized and the yield of the reaction products increased, i.e. the ratio between the apparatus cost to the yield of the reaction can be minimized, by combining the isothermically operated reactor with the adiabatically operated reactor. The system of the present invention eliminates the need for further reactors as will be apparent hereinafter and also obviates any need to provide gas/liquid contactors for the reactants to be introduced into the system.

A further advantage of the system of the present invention is that it allows control of the process by relatively simple means and mechanisms such as valves and without the complex control technology which has hitherto been required.

It is also an advantage of the invention that the temperature at which the chemical reaction is carried out in the isothermically operated reactor can be achieved by heat exchange between the feedstock and the reaction products from the adiabatically operated reactor.

Since the total reaction is divided up into a plurality of reactors by the combination, according to the invention, of isothermically and adiabatically operated reactors, the catalysts in the individual reactors need not be subjected to an excessive thermal loading. Thus, the catalysts used in the reactors of the present invention have an increased life by comparison with catalysts used in earlier systems.

Since reduced temperatures prevail in all of the reactors of the system of the present invention, the sintering of catalysts at high reaction temperatures, which occurs in some earlier systems, to reduce the effective surface area and catalyst efficiency, is avoided with the system of the invention.

It is possible, especially in the isothermically operated reactor, to employ high-efficiency catalysts which cannot withstand operating temperatures above 500° C.

In accordance with one embodiment of the invention, the process is carried out by passing the reactants first through the adiabatically operated reactor and then through the isothermically operated reactor. This arrangement has the advantage that a part of the reactants have already been reacted in the adiabatically operated reactor before the reaction mixture enters the isothermically operated reactor; the catalyst and the subsequently traversed isothermically operated reactor is therefore not highly loaded. For the same reason, the cooling to maintain isothermic conditions in the latter reactor need not be as extensive since this reactor does not operate at an excessively high temperature. There is also less danger to the system from a runaway reaction.

In accordance with another embodiment of the invention, the adiabatically operated reactor is provided downstream from the isothermically operated reactor. This arrangement has the advantage that the feeding of significantly or predominantly reacted gas from the isothermically operated reactor enables precise control of the discharge temperature of the adiabatically operated reactor. Because the temperature at the outlet of the adiabatic reactor is lower, the cost of subsequent units of the apparatus, such as heat exchangers or steam superheaters can be less since less costly materials can be used in fabricating them.

According to still another embodiment of the invention, the reactants are subdivided into two streams, one of which is charged into the isothermically operated reactor while the second traverses the adiabatically operated reactor. The principal advantage of this arrangement is that it allows optimum process conditions to be maintained in spite of fairly wide variations in the throughputs of the reactants.

A particularly advantageous embodiment of the invention provides a parallel connection of an isothermic and an adiabatic reactor in which simultaneously a portion of the reactants traverses both the isothermic and the adiabatic reactor, whereafter the reaction mixtures are brought together. The reaction mixture withdrawn from the isothermic reactor includes reaction-limiting components with respect to further exothermic reaction. When the reaction mixture is supplied to the adiabatic reactor, the quantity of the reactants to be transformed and thus the temperature of the reactor can be established precisely.

The advantages of the present invention may also be exploited when the reaction mixture produced in the isothermic reactor is only partly introduced into the adiabatic reactor, whereupon all of the reaction mixtures are recombined. In all cases of this type and in which the reactants are partially reacted in an isothermic reactor, the adiabatic reactor has a reduced loading.

Since the process of the present invention requires a mixture of gases to serve as the feedstock which has conventionally been produced in a relatively expensive manner, it is important for optimum reaction technology and good energy utilization to increase the mixing efficiency or reduce the cost of the overall process by reducing the energy consumption of the mixing operation. In accordance with a feature of the invention, the reaction-generated heat is used on the one hand to vaporize water and produce steam and, on the other hand, to convert this steam to high pressure or superheated steam. Part of the steam can be introduced into the reactors while the greater portion can serve as process steam in other chemical processes or as steam for the generation of electrical energy, thereby recovering its value as part of the energy balance of the system.

It has been found to be advantageous to carry out the evaporation of water (at least initial steam generation) completely in the isothermic reactor so that an additional evaporating unit can be avoided. By combining the isothermic reactor and the evaporator in a single unit, there is a substantial reduction in energy loss by comparison with a system in which the reactor and the evaporator unit constitute two separate apparatuses.

The further or superheating of the steam can then be carried out, according to an important feature of the invention, by heat exchange with the gases discharged from the adiabatic reactor. In this case, the steam generated in the isothermic reactor is superheated with the sensible heat of the gases discharged from the adiabatic reactor to provide an especially effective energy balance and high steam yields. In fact, from an energy point of view there is increased yield of superheated steam with the invention system over that which obtains with an evaporator unit and an adiabatically operated reactor.

According to a further feature of the invention, the sensible heat of the reaction product from the isothermic reactor can be used to superheat steam in addition or as an alternative. This is especially desirable when the discharge temperature is higher than is required in the adiabatic reactor.

Of course, by carrying out the process of the present invention in a plurality of reactors, it is possible that the yield of the desired product may be greater at a point along the process path at which the reaction mixture has not traversed all of the reactors. In this case, recovery of the reaction product may take place at such an intermediate point. The reaction process may be continued beyond this point, if desired, in order to obtain an improved energy balance or utilization at the cost of product yield. The choices may be made in accordance with the relative importance of the decrease in yield and the increase in retrievable energy.

The system of the present invention has the further advantage that, especially when high-pressure superheated steam is produced, neither type of reactor will be subject to overloading.

In the embodiment of the present invention in which the process is carried out by passing the gas mixture first through the adiabatic reactor, it can become necessary to dilute the gas with steam in order to reduce the reaction temperature at the discharge side of the reactor. The addition of steam to the reactants can also be required or desirable when, in the synthesis of methane from carbon monoxide and hydrogen, it is necessary to reduce the tendency to elemental carbon deposition, i.e. soot formation. In either case, steam generated by the process of the present invention is preferably used and it should be noted that the steam required for this purpose is generally only a minor proportion of the total quantity of steam which the invention is capable of producing.

By the conversion of water to steam in the isothermic reactor and the subsequent generation of high-pressure of superheated steam, one obtains by simple means, an accurate control of the temperature of the isothermic reactor since the latter is cooled by the water which is at its boiling point. Thus, one need only control the back pressure upon the water to regulate with a high degree of accuracy the temperature of the isothermic reactor within a relatively wide range. If the water vapor in the evaporator is held at a predetermined pressure, there is a corresponding boiling temperature for the water which is transformed to steam and this is the temperature which is maintained at the reactor.

The system of the present invention, using at least two distinct types of reactors is not limited to any specific reactions although the principal utility is in the conversion of carbon oxides to methane. In general terms the system is useful for all strongly exothermic reactions carried out in a gas phase and particularly such reversible equilibrium reactions as the synthesis of ammonia, methanol synthesis, hydrogenation of hydrocarbons and the hydrogenation of carbon monoxide and carbon dioxide to methane. If a higher throughput is required, naturally, still further adiabatically operated reactors can be provided.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
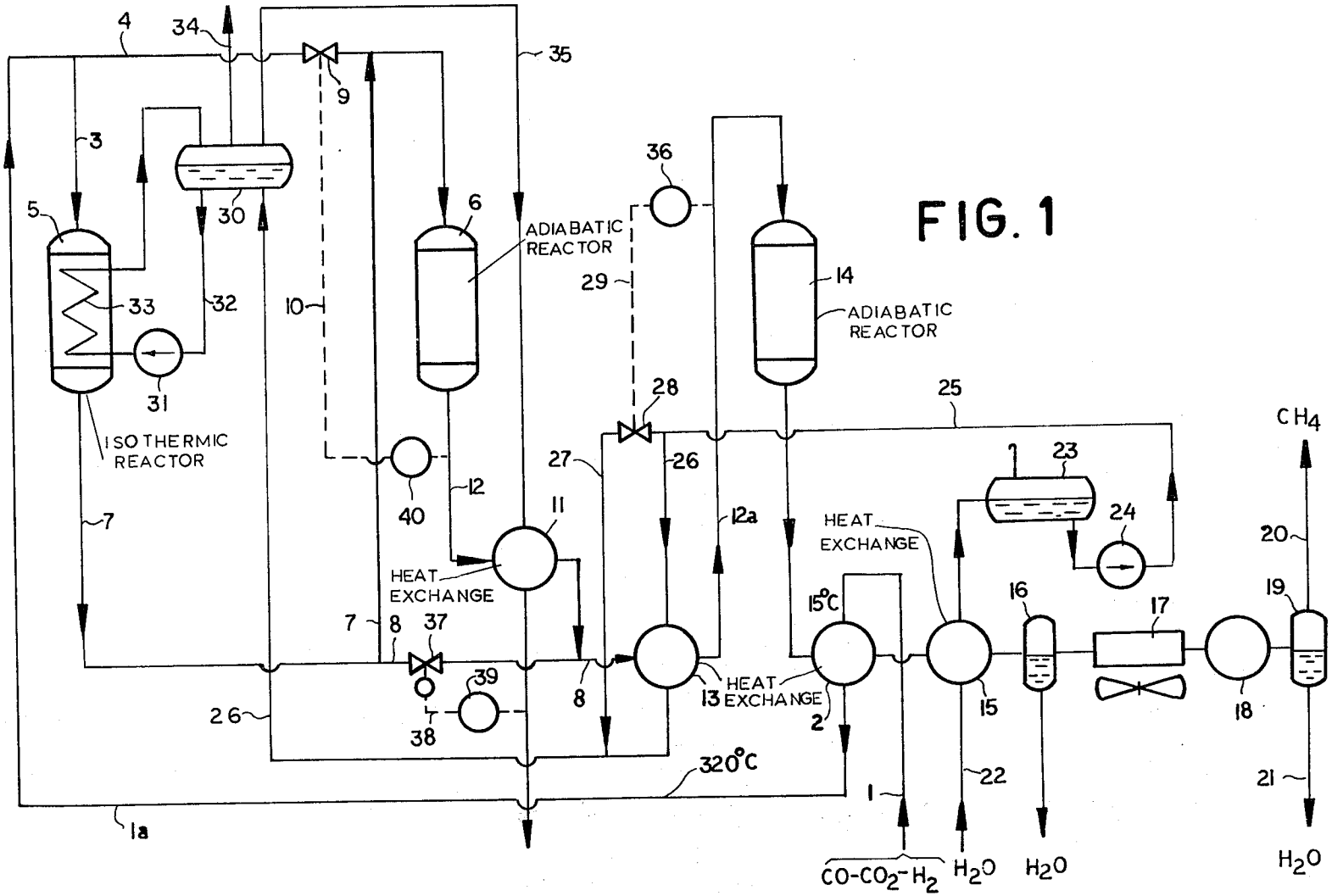
FIG. 1 is a flow diagram of a plant for the production of methane from carbon monoxide and carbon dioxide, according to the invention, using an isothermic reactor and a parallel and simultaneously serially connected adiabatic reactor.

In the system of FIG. 1, the reactants for the methane-producing reaction are introduced at 1 to a heat exchanger 2 in which the reaction mixture is raised from a temperature of about 15° C. to the temperature of about 320° C. corresponding to the temperature at which the first stage reaction takes place. The heat exchanger 2 is thus a preheater. The output from the heat exchanger 2 is carried off via line 1*a* and is split into the two lines 3 and 4. Line 3 introduces the reaction mixture into an isothermic reactor 5 which is operated at the aforementioned temperature of 320° C., while line 4 runs to an adiabatically operated reactor 6. Valve 9 controls the splitting of the reaction mixture between lines 3 and 4 so that approximately 3-quarters of the gas mixture traversing line 1*a* is supplied to the isothermic reactor 5 while the remainder is fed directly to the adiabatic reactor 6. The valve 9 is provided with a control system represented by a temperature sensor 40 which measures the temperature at the line 12 at the outlet of the adiabatic reactor 6 to adjust the distribution of the gas mixture to lines 3 and 4 so as to maintain the outlet temperature of the adiabatic reactor 6 substantially constant. A line 7 carries the major portion of the reaction products (product mixture) from the isothermic reactor 5 to the line 4 downstream of the valve 9 to mix this portion of the reaction product with the feedstock of the adiabatic reactor 6. The resulting mixture is reacted in the adiabatic reactor 6 and has at the outlet side of this reactor a temperature of about 550° C. The products are then passed through a heat exchanger 11 in which the reaction products are cooled.

The remainder of the reaction product of reactor 5 is combined with the reaction products from reactor 6 in a line 8 and then passed through a heat exchanger 13 in which the reaction products are cooled to about 240° C.

The proportion of the reaction product from reactor 5 distributed between line 7 to the adiabatic reactor 6 and line 8 to the heat exchanger 13, is controlled by a valve 37.

From the heat exchanger 13, the total reaction mixture is fed via a line 12*a* to a further adiabatic reactor in which the final methanization of residual reactants occurs.

The reaction products are then passed through the heat exchanger 2 so that a portion of their heat is used to preheat the reactants introduced at 1. The reaction products are then passed through a further heat exchanger 15, a water separator 16 in which water is condensed from the gas stream, and a pair of heat exchangers 17 and 18 in which further cooling takes place. Still another water separation is effected at 19 and the methane gas is obtained at 20 while the water formed in the reaction process is discharged at 21.

As previously noted, the system of FIG. 1 is used to generate high-pressure or superheated steam, thereby recovering in a useful manner the exothermically produced reaction heat.

Water is supplied by line 22 and is preheated in a heat exchanger 15 located upstream of a vapor separator 23, which can be a steam boiler, in which the water is degassed. A pump 24 feeds the water at a pressure of about 100 bar through line 25 which splits into a line 26 and a line 27, the distribution of the water between these lines being controlled by a valve 28 responsive to the temperature of the gases fed to the adiabatic reactor 14 as determined by the temperature sensor 36. The portion of the water passing along line 26 is heated in the indirect heat exchanger 13 and is supplied to a high-pressure steam boiler 30. A pump 31 circulates water from this high-pressure boiler 30 via a line 32 through the coil 33 within the isothermic reactor 5, the steam returning to the boiler 30. Coil 33 maintains a constant temperature in the isothermic reactor 5. A portion of the steam at high pressure can be led off at 34 for any desired application. A line 35 runs from the high-pressure boiler 30 to the heat exchanger 11 where the steam is heated from a temperature of 320° C. to 500° C. for use as product steam.

With the aid of the temperature of the product steam from the heat exchanger 11, which temperature is maintained by the temperature sensor 39 through control of the valve 37 as represented by line 38, it is possible to produce electrical energy or contribute heat which would otherwise be wasted to some other point in the plant. The temperature of the product steam serves to control the distribution of the reaction product from the isothermic reactor 5 to the adiabatic reactor 6 and the adiabatic reactor 14, respectively.

Table I below gives the compositons of the various fluid streams in mole percent at various points. Other parameters of the example are given as well.

TABLE I

| | Inlet 1 | After Reactor 5 | After Reactor 6 | After Reactor 14 |
|---|---|---|---|---|
| $H_2$ | 64.9 | 2.9 | 22.2 | 4.6 |
| $N_2$ | 4.7 | 13.1 | 10.5 | 12.8 |

TABLE I-continued

| | | | | |
|---|---|---|---|---|
| CO | 10.5 | 0.0 | 0.9 | 0.0 |
| $CH_4$ | 10.8 | 81.3 | 59.9 | 79.5 |
| $CO_2$ | 9.1 | 2.7 | 6.5 | 3.1 |
| Temperature °C. ca. | Inlet 1 | After Reactor 5 | After Reactor 6 | After Reactor 6 |
| | 15 | 320 | 550 | 355 |
| Process Pressure 20 bar. | | | | |

When 600 $m^3$/h of the reactant mixture is to be converted in the process described above, 300 kg/h of steam at a pressure of 100 bar, superheated to 500° C., are produced.

Figure 2:
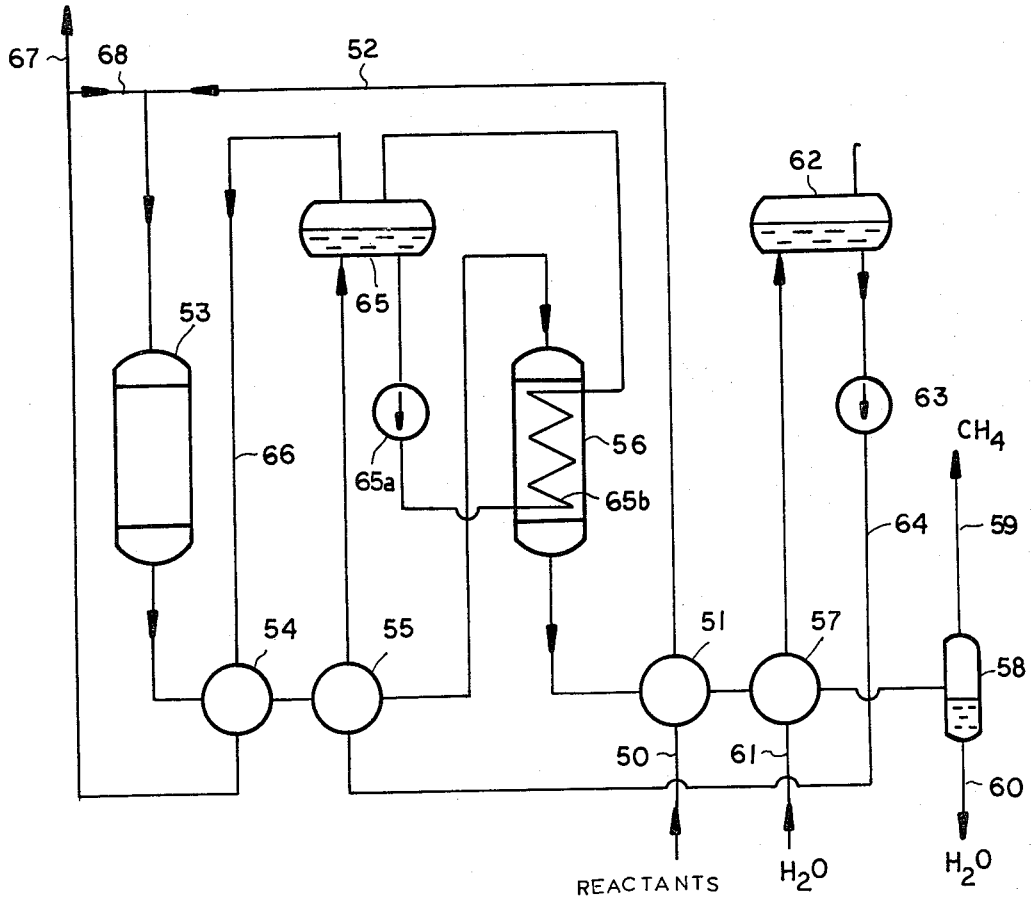
FIG. 2 is a flow diagram illustrating a system using an isothermic reactor and an adiabatic reactor provided ahead of the isothermal reactor.

In the embodiment of FIG. 2, the reactants are fed via a line 50 to a preheater 51 and then to an adiabatic reactor 53. The reactants are thereby heated from a temperature of 300° C. to a temperature of 750° C. at the outlet of the adiabatic reactor. The reaction mixture from the adiabatic reactor 53 flows via heat exchangers 54 and 55 to an isothermically operated reactor 56 which is maintained at a temperature of 310° C. to 340° C.

The reaction products from the isothermic reactor 56 are cooled in heat exchangers 51 and 57, prior to separation of water at 58 and discharge of methane at 59 and water at 60. The heat exchanger 51 passes the reactants of line 50 in indirect heat exchange with the reaction products from the isothermic reactor 56 while the heat exchanger 57 recovers additional sensible heat by preheating the water which is supplied to the boiler 62. The hot water from the boiler 62 is circulated by pump 63 and line 64 through the heat exchanger 55 in which this water is passed in indirect heat exchange with the reaction products from the high temperature adiabatic reactor 53. The water is then supplied to the boiler 65 which is connected in a circulating path with a pump **65*a* and a coil 65*b* of the high-temperature steam producer. The coil 65*b* in the isothermic reactor 56 serves to cool the latter and maintain a constant temperature therein. High-temperature steam is further heated in heat exchanger 54 to which it is conducted via line 66 and the superheated steam may be withdrawn to further use elsewhere in the plant 67 while a portion of this steam may be mixed with the reactants in line 52** as a diluent as described previously.

In a specific example of the operation of this system, which is represented in Table II, the compositions of the various fluid streams have been given in mole percent together with various other data relevant to the example.

TABLE II

| Inlet 52 | | Ahead of Reactor 53 | After Reactor 53 | After Reactor 56 |
|---|---|---|---|---|
| $H_2$ | 66.0 | 66.0 | 50.9 | 4.5 |
| $N_2$ | 4.6 | 4.6 | 6.6 | 12.9 |
| CO | 10.3 | 10.3 | 9.0 | 0.0 |
| $CH_4$ | 9.7 | 9.7 | 26.5 | 79.5 |
| $CO_2$ | 9.4 | 9.4 | 7.0 | 3.1 |
| $H_2O$ in kg/600 $m^3$ (STP) | 0.2 | 40.4 | 104.8 | 170.7 |
| Temperature °C. ca. | 15 | 280 | 750 | 340 |
| Process Pressure 30 bar. | | | | |

This second example gives 360 kg/h of steam at a pressure of 100 bar and at a temperature of 500° C. Only 40 kg/h of steam is diverted at 68 to control the adiabatic reactor 53.

Figure 3:
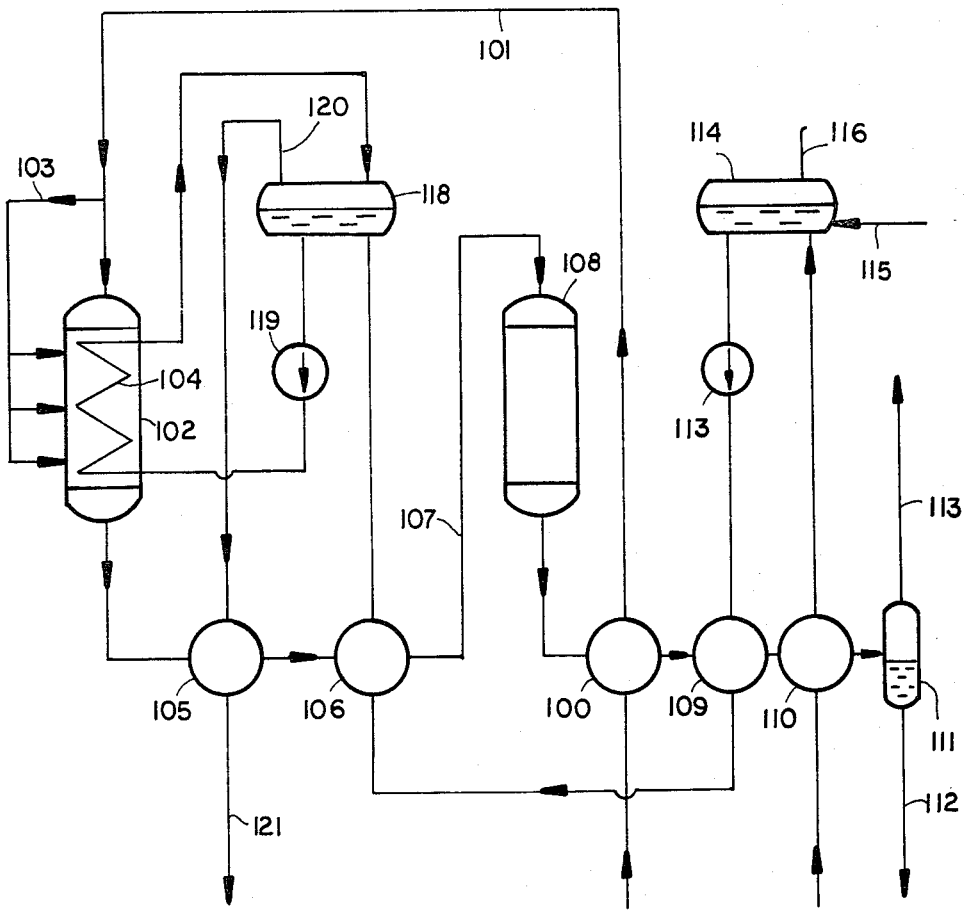
FIG. 3 is a view of a system utilizing the isothermic reactor ahead of the adiabatic reactor.

In the embodiment of FIG. 3, hydrogen-rich reaction gas is heated in heat exchanger 100 to about 320° C. and is fed via line 101 to a quasi-isothermic reactor 102, a portion of the feedstock is diverted from line 101 via line 103 and branched to several locations along the isothermically operated reactor 102.

Within this quasi-isothermic reactor 102, the gas mixture reacts exothermically with the greater portion of the reaction heat being recovered by heating of the boiling water in the tube coil 104, this boiling water being at a pressure of 100 bar and a temperature of 310° C. at introduction into the coil. The remaining reaction heat is transformed into sensible heat of the reaction gases so that these gases leave the reactor 102 with a temperature of about 600° C. The reaction product gases are then cooled in heat exchangers 105 and 106 to a temperature of about 280° C. The reaction product gas is then fed via line 107 to the adiabatic reactor 108 with the reaction products from this reactor being fed in succession through the heat exchangers 100, 109 and 110. A water separator 111 removes water from the reaction product so that methane is recovered at 113. The feed water for the production of steam is preheated in the heat exchanger 110 and is collected in the storage tank 114 where it can be further heated with steam supplied via line 115. A steam/gas mixture may be withdrawn at 116. The degassed water is fed by pump 117 through the heat exchanger 109 at a pressure of 100 bar and, after being further heated at 106 is supplied to the steam boiler 118. The pump 119 and the coil 104 permit circulation of the water from the boiler 118 for superheating in coil 104 and control of the temperature in the reactor 102. The steam is removed at 120 and is further heated at heat exchanger 105 by heat exchange with the reaction products from the isothermic reactor before being delivered to a steam consumer as represented at 121.

The operating parameters of an example for the system of FIG. 3 are given in Table III, the compositions being in mole percent.

TABLE III

| | Inlet | After Reactor 102 | After Reactor 108 |
|---|---|---|---|
| $H_2$ | 69.3 | 29.3 | 11.2 |
| CO | 10.7 | 1.4 | 0.05 |
| $CH_4$ | 10.7 | 63.1 | 86.0 |
| $CO_2$ | 9.3 | 6.2 | 2.75 |
| Temperature °C. | 30 | 612 | 440 |
| Process Pressure 45 bar. | | | |

With a reactant mixture at a rate of 600 $m^3$/h (STP), the system of FIG. 3 yields 370 kg/h of high-pressure steam at a pressure of 100 bar and a temperature of 500° C.

Any conventional catalyst can be used in either reactor of any of the three embodiments and a preferred catalyst system for this purpose is palladium on carbon.

We claim:

1. A process for carrying out a strongly exothermic catalytically promoted chemical reaction to form methane, comprising the steps of:

forming reactant-gas mixture of at least two components capable of undergoing catalytically promoted exothermic reaction, said components consisting essentially of hydrogen and carbon oxide;

subdividing said reactant-gas mixture into two streams;

passing a first of said streams of said reactant-gas mixture into contact with a catalyst in an adiabatic exothermic methanization reaction stage without heating the latter or abstracting heat from the latter to produce a first product mixture;

passing the second of said streams of said reactant-gas mixture through an isothermal exothermic methanization reaction stage into contact with a catalyst capable of promoting said reaction to produce a second product mixture while abstracting heat from said isothermal reaction stage to maintain a substantially constant temperature therein; and controlling the distribution of said reactant-gas mixture between said streams in response to the temperature of said first product mixture to prevent excessive temperatures from developing in said adiabatic reaction stage, portion of said second product mixture being passed through said adiabatic reaction stage.

* * * * *